United States Patent [19]

Fujimi et al.

[11] 3,998,312

[45] Dec. 21, 1976

[54] PRINTING OR STAMPING DEVICE

[75] Inventors: Yukio Fujimi, Narashino; Akihiro Miwa, Funabashi, both of Japan

[73] Assignee: Kabushiki Kaisha Daini Seikosha, Japan

[22] Filed: Dec. 26, 1974

[21] Appl. No.: 536,401

[30] Foreign Application Priority Data

Dec. 28, 1973 Japan ..... 49-908

[52] U.S. Cl. ..... 197/55; 101/93.19; 197/6.5; 101/110

[51] Int. Cl.[2] ..... B41J 1/22

[58] Field of Search ..... 197/6.4–6.7, 197/55; 101/93.15, 93.19, 93.47, 95, 99, 110, 93.29

[56] References Cited

UNITED STATES PATENTS

| | | | |
|---|---|---|---|
| 3,406,625 | 10/1968 | Chamness et al. | 197/55 X |
| 3,640,216 | 2/1972 | Piazza | 101/110 X |
| 3,643,596 | 2/1972 | Vorbach et al. | 101/93.19 |
| 3,659,524 | 5/1972 | Beery et al. | 101/93.19 |
| 3,731,622 | 5/1973 | Baranoff | 101/110 X |
| 3,807,542 | 4/1974 | Jung | 197/55 |
| 3,861,512 | 1/1975 | Coriasco et al. | 197/55 |
| 3,872,789 | 3/1975 | Ambrosio | 101/93.29 |

*Primary Examiner*—Edward M. Coven
*Attorney, Agent, or Firm*—Robert E. Burns; Emmanuel J. Lobato; Bruce L. Adams

[57] ABSTRACT

A printing or stamping device for marking checks and similar documents comprises a rotatable type ring having a plurality of types around its periphery and a keyboard having a plurality of manual key-switches each corresponding to one type on the type ring. An angular position detector detects the angular position of the type ring and includes a coded disc which rotates in synchronism with the type ring and develops successive position signals indicative of the successive angular positions of the type ring. Control circuitry including a memory stores data typed-in on the keyboard and transmits successive typed-in signals to a coincidence detector which detects the coincidence of a typed-in signal and the corresponding position signal and provides a coincident signal. The coincident signal activates a stopper mechanism to stop the rotation of the type ring at a position where the typed-in type faces the check. A lever system then pivots the type ring to print that type on the check after which the check is advanced one space in readiness for the next printing. After the printing and advancement of the check, the stopper mechanism releases the type ring and the cycle is repeated until all of the typed-in data is printed on the check.

10 Claims, 11 Drawing Figures

| Type Figure | Key-switch | Bit 4 | Bit 1 | Bit 2 | Bit 3 |
|---|---|---|---|---|---|
| 0 | $3_1$ | 0 | 0 | 0 | 0 |
| 1 | $3_9$ | 1 | 0 | 0 | 0 |
| 2 | $3_2$ | 0 | 1 | 0 | 0 |
| 3 | $3_{10}$ | 1 | 1 | 0 | 0 |
| 4 | $3_3$ | 0 | 0 | 1 | 0 |
| 5 | $3_{11}$ | 1 | 0 | 1 | 0 |
| 6 | $3_4$ | 0 | 1 | 1 | 0 |
| 7 | $3_{12}$ | 1 | 1 | 1 | 0 |
| 8 | $3_5$ | 0 | 0 | 0 | 1 |
| 9 | $3_{13}$ | 1 | 0 | 0 | 1 |
| ※ | $3_6$ | 0 | 1 | 0 | 1 |
| — | $3_{14}$ | 1 | 1 | 0 | 1 |
| $ | $3_7$ | 0 | 0 | 1 | 1 |
| • | $3_{15}$ | 1 | 0 | 1 | 1 |
| , | $3_8$ | 0 | 1 | 1 | 1 |
| | $3_{16}$ | 1 | 1 | 1 | 1 |

PRINTING OR STAMPING DEVICE

BACKGROUND OF THE INVENTION

This invention relates generally to a printing or stamping device such as a check writer and more particularly to a device to print or stamp figures, symbols or letters on a check, bill, certificate, receipt, card or the like (hereinafter referred to as a check) in response to short operator strokes and light operator touches on the keys.

One typical prior art construction, such as depicted Japanese Patent Publication No. 37-10825, comprises a drum having a plurality of electric contacts or stopper dogs arranged a spiral fashion on the drum periphery, a type ring fixed coaxially on a common shaft of the drum, and contact elements each of which faces one of the contacts on the drum.

The drum is stopped by one of the contact elements making contact with the corresponding contact or stopper dog at a desired angular position when the corresponding key on a key-board is pushed down. Thus, a selected letter on the type ring is printed out on a sheet.

A printing device of the character just briefly described requires the operator to keep on pushing down a key until the letter is printed out. Further, it may print the same letter twice or thrice successively in case the operator keeps the key depressed too long. Therefore, it is heavy and skilled work to use such a printing device.

BRIEF SUMMARY OF THE INVENTION

The present invention has been developed for eliminating the afore-mentioned defects in the prior art constructions.

A printing or stamping device of this invention comprises a type ring, an angular position detector for detecting the ring position and transmitting corresponding angular position signals to a coincidence detector, a key-board whose type-in signals are transmitted to said coincidence detector through a memory, a stopper for the type ring, and a type ring drive means. The stopper and drive means are enabled and activated into operation by the coincidence of a type-in signal and an angular position detecting signal thereby effectively eliminating the defects in prior art devices.

It is, therefore, an object of the present invention to provide a printing or stamping device which is operated with higher speed and higher accuracy by light and short finger-touches on the key-switches.

It is another object of the present invention to provide a printing or stamping device which is readily suitable for use in computer input/output terminal check writers.

It is a further object of the present invention to provide a printing or stamping device with which printed letter pitches are properly selected in accordance with printed letters.

DETAILED DESCRIPTION OF THE INVENTION

Figure 1:
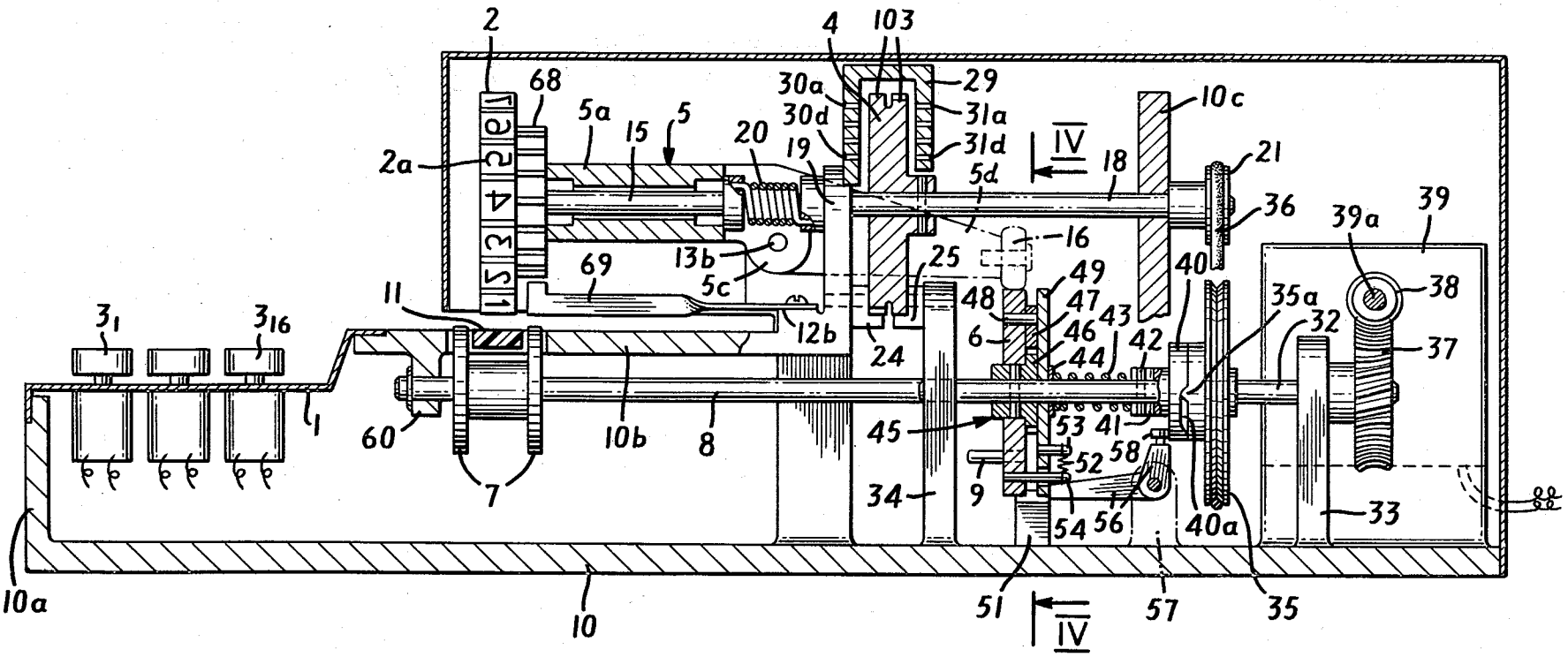
FIG. 1 is a longitudinal sectional view of a preferred embodiment of a printing or stamping device in accordance with the present invention.

Referring to the attached drawings, in FIG. 1, there is shown a printing or stamping device of the invention which includes a key-board 1, type ring 2 connected to a rotary member 4 of an angular position detector, drive means including a printing lever 5 and a cam 6, and variable feed means including feed wheels 7, its shaft 8 and a drive pin 9, as described hereinafter.

Numeral 10 designates a frame body. The key-board 1 is securely mounted on a front projected portion 10*a* of said frame body, said key-board having a plurality of key-switches $3_1$ to $3_{16}$ arranged thereon. Each key-switch is respectively provided with the mark of a letter, figure or symbol on the push button thereof so as to display the letter, figure symbol which will be printed when each key-switch is actuated. A print receptacle 11 is mounted on a flat portion 10*b* of the frame body at a location just rear of the key-board 1, said receptacle having a knurled top surface. Brackets 12*a* and 12*b* are, as particularly shown in FIG. 2, secured vertically on the rear portion of flat portion 10*b*, spaced from each other in parallel. The printing lever 5 is swingably mounted on said brackets 12*a* and 12*b* by means of fulcrum pins 13*a* and 13*b* which are disposed in recesses 14*a* and 14*b* of said brackets 12*a* and 12*b* respectively. A type shaft 15 having the type ring 2 on the nose thereof is rotatably mounted at a front portion 5*a* of said printing lever 5. A plurality of types 2*a* are so arranged on a round surface of said type ring 2 that each of the types can be moved into position to press against said print receptacle 11. Said type ring 2 is kept in adequate pressure contact with an ink roller, which is not shown in the drawings, at the afore-mentioned round surface for supplying ink to the types.

Figure 2A:
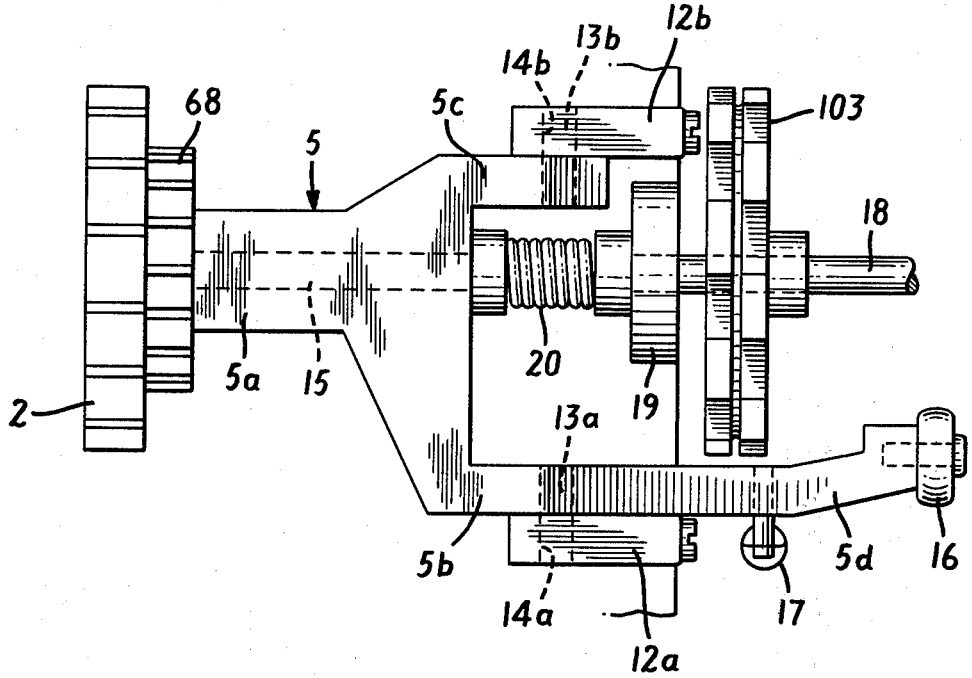
FIG. 2*a* is a plan view partially cut-away showing the relation of a type ring and a printing lever in a type ring drive means.
Figure 2B:
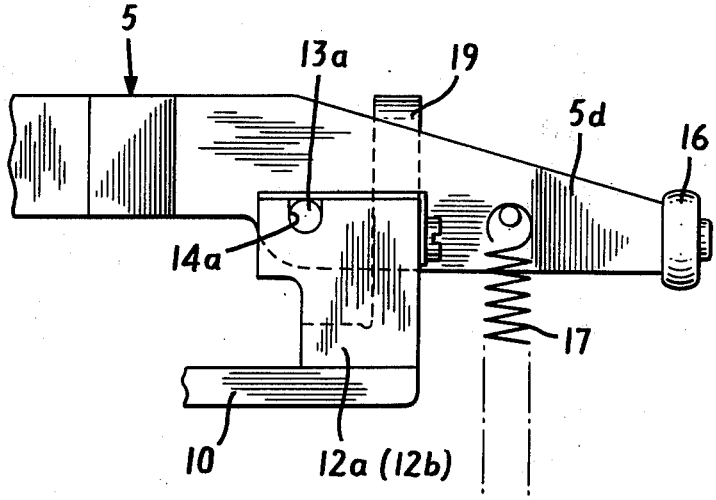
FIG. 2*b* is a partial side view of FIG. 2*b*.

As shown in FIG. 2, one of forked portions 5*b* and 5*c* of the printing lever 5 is extended to form a transmitting portion 5*d* on which a cam follower 16 is rotatably mounted at the end portion thereof. A spring 17 is set between the transmitting portion 5*d* and the frame body 10 so as to swing the printing lever 5 in the clockwise direction in FIG. 1 or 2 to press the cam follower 16 towards the cam surface of the cam 6, separating the type ring 2 from the print receptacle 11.

An indexing shaft 18 is rotatably mounted on both bracket 19 and rear wall portion 10*c* of the frame body 10, the bracket 19 being securely fixed on the flat portion 10*b*. Said indexing shaft 18 being arranged coaxially with said type shaft 15, the front end thereof being connected to the type shaft 15 with a flexible member 20 such as a coil spring, and on the other end of the indexing shaft 18 is secured a smaller pulley 21.

The rotary member 4 is securely mounted on the front portion of said indexing shaft 18, said member 4 having two index rings 103 on the periphery thereof. Each of said index rings 103 has respectively a plurality of catching portions 22*a* (22*b*) such as engaging notches spaced between a cylindrical portion 23*a* (23*b*) and the adjacent one 23*a* (23*b*). The catching portions 22*a* and 22*b* are equal in to the number of total number with said types 2*a* and to the number of said key-switches $3_1$ to $3_{16}$ and each of the catching portions correspond to one of the types and they are arranged in such a manner that contiguous catching portions 22*a* on the index ring correspond to the types on the type ring, as is particularly shown in FIG. 3*a*.

Two stop members 24 and 25 are respectively swingably supported on a common pin at the central portions thereof, each of said stop members facing an index ring 103 at the front end thereof and being pivot-jointed to a plunger 26*a* (or 27*a*) of an electromagnet 26 (or 27). Each of said electromagnets is energized to swing its associated stop member 24 (or 25) so as to press the free end of the stop member against the corresponding index ring 103 at a cylindrical portion 23 thereof, thereby braking the index ring rotation then stopping and the index ring due to the stop member engaging in the next adjacent catching portion, indexing 22. In this manner, the index ring is indexed to a position in which the desired type on the type ring faces the print receptacle 11, and this occurs when a coincidence signal output is given from a coincidence detector as hereinafter described.

As the angular positioning stopper includes a plurality of index rings and their stop members, each of said index rings having catching portions for ensuring precise positioning and rather wide cylindrical portions for braking, very smooth stopping with accurate and quick positioning of the type ring is obtained without any disturbance caused by high speed rotation of the type ring.

Figure 3A:
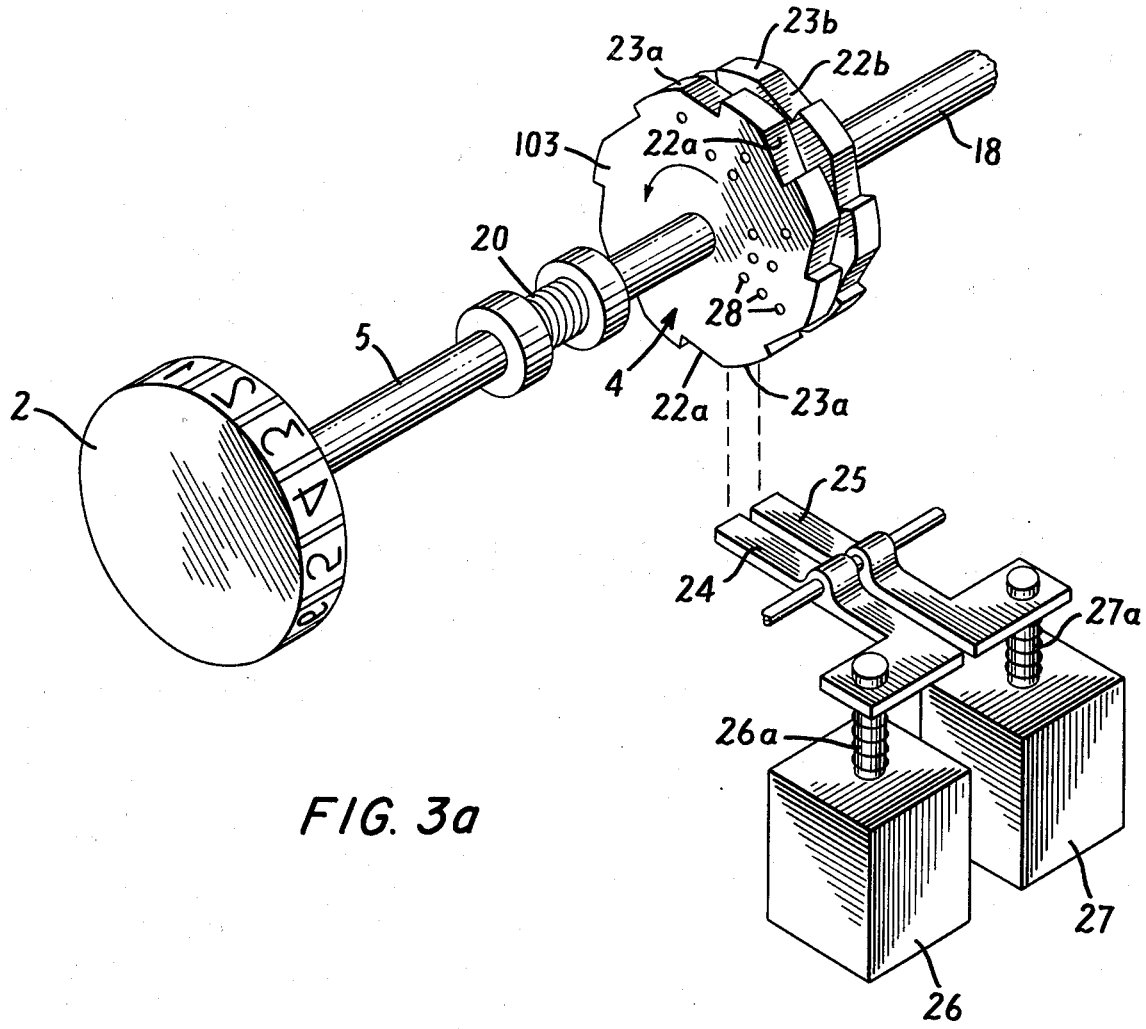
FIG. 3*a* is a perspective view showing the type ring and an angular positioning stopper thereof, partially separated for better understanding.
Figure 3B:
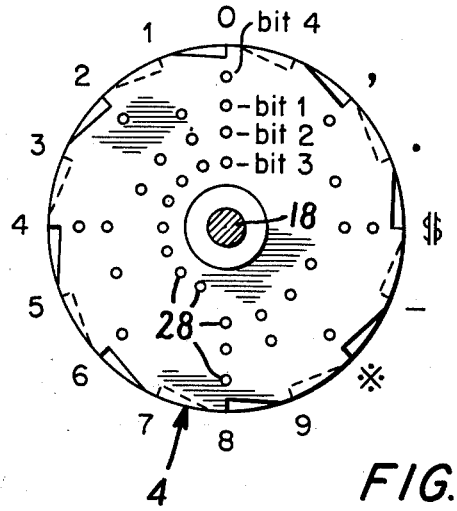
FIG. 3*b* is a front view of an index ring having sensing perforations therein.
Figures 6, 7:
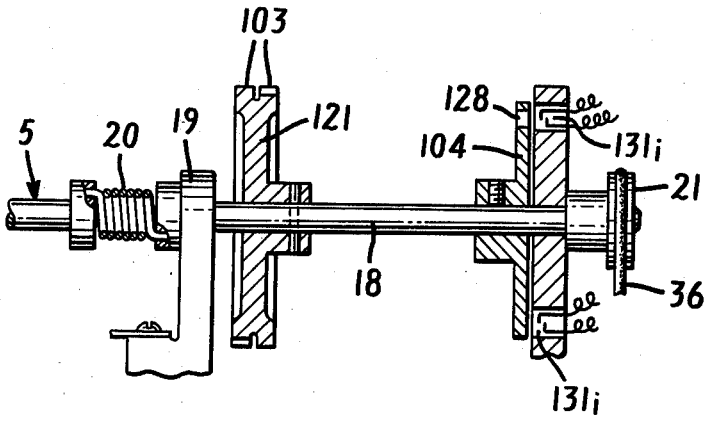
FIG. 6 is a table showing angular position codes of the type ring in relation to type letters and key-switches on a key-board which are suitable for the device using the circuit of FIG. 5.
FIG. 7 is a longitudinal sectional view showing another embodiment of an angular position detector.

Perforations 28 are arranged at some points of intersections of concentric circles and radial lines of said rotary member 4, forming a binary code mark of 4 bits corresponding to each of the types of said type ring in each of the radial lines as shown in FIG. 3*b* and the coding detail shown in detail in FIG. 6. Reading means coacts with the coded rotary member 4 to read the coded information and as best seen in FIG. 1, the reading means comprises a ⊓ -shaped holding member 29 is securely mounted on said bracket 19, said holding member 29 having 4 luminous elements 30*a* to 30*d* in a straight line on one side wall and four light-sensitive elements 31*a* to 31*d*, such as photo transistors, on the other side. Said luminous elements and said light-sensitive elements are so arranged that a code mark correpsonding to a type, which is coming to face the print receptacle 11, is detected by the light-sensitive elements 31*a* to 31*d*, the code mark perforations coming in between said light-sensitive elements and luminous elements.

Numeral 32 is a drive shaft, in parallel with said indexing 18, rotatably supported by brackets 33 and 34 which are securely mounted on the frame body 10. A larger pulley 35 is rotatably mounted on said drive shaft 32, and a belt 36 is passed round pulleys 21 and 35 for transmitting the drive shaft rotation to the type shaft 15 through the indexing shaft 18. Said drive shaft 32 is provided with a worm wheel 37 fixed at the rear portion thereof and said worm wheel is meshed with a worm 38 which is fixed on a motor shaft 39*a* which is driven by a drive motor 39 mounted on the frame body 10.

A flange 40 is both mounted for rotation with and mounted for axial slidable movement on said drive shaft 32, a pair of slots 41 in the boss thereof being engaged with a pin 42 fixed on the drive shaft 32. Said flange 40 has a recess 40*a* on the end surface facing said larger pulley 35, said recess 40*a* being engaged with a projected portion 35*a* on the boss end of the larger pulley 35. A coil spring 43 is set between the flange 40 and a washer 44 on the drive shaft 32, pressing the flange 40 against the larger pulley 35.

Figure 4A:
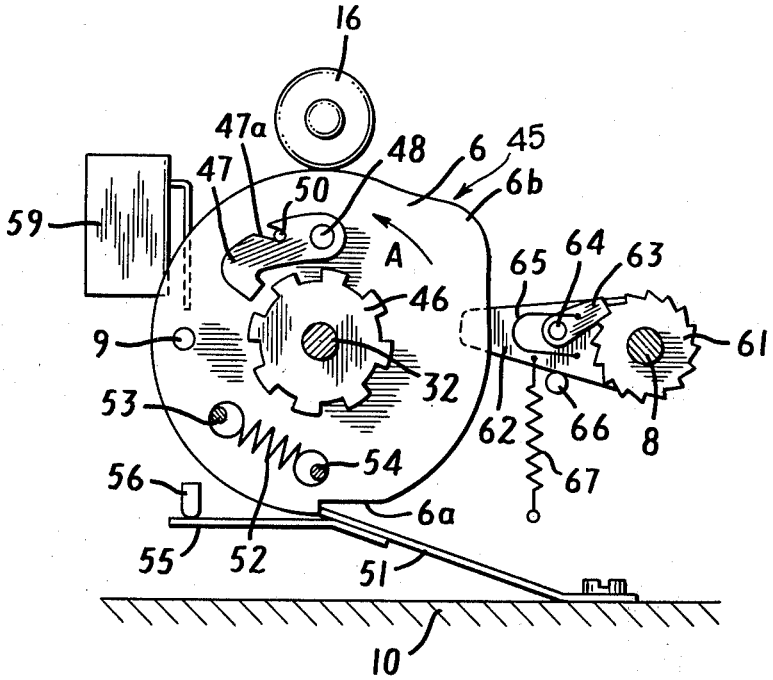
FIG. 4*a* is a front view taken along line IV—IV in FIG. 1.
Figure 4B:
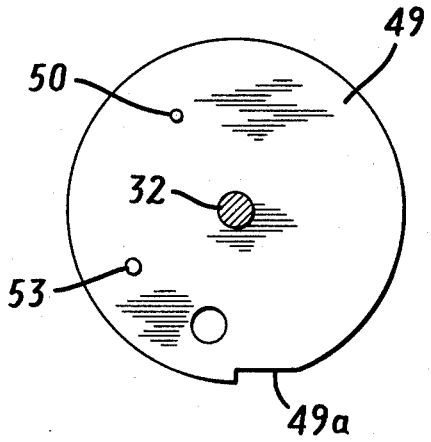
FIG. 4*b* is a front view of a clutch operating disc in the device of FIG. 1.

Numeral 45 is a one-cycle clutch, which comprises, as shown in FIG. 4*a* and FIG. 4*b*, a ratchet wheel 46 securely fixed on the drive shaft 32. On the boss of said ratchet wheel 46 is rotatably mounted the cam 6, and a ratchet 47 is supported on the cam 6 swingably around a pin 48 protruded therefrom, said ratchet 47 being positioned to mesh with said ratchet wheel 46. A ratchet drive disc 49 is supported rotatably on the drive shaft 32 between said washer 44 and said ratchet wheel 46 and has a protruded pin 50 which engages with a slot 47*a* cut obliquely in the ratchet 47, and a stopper spring 51 is fixed on the frame body 10. A spring 52 is set between a protruded pin 53 fixed on the ratchet drive disc 49 and a protruded pin 54 on the cam 6, so that the ratchet drive disc 49 is forced to rotate in the direction of arrow A in FIG. 4*a* relative to the cam 6, thereby making the ratchet 47 swing in the counterclockwise direction and mesh with the ratchet wheel 46 during the clutch-on condition. The free end of the stopper spring 51 is engageable with both notches 6*a* on the cam 6 and 49*a* on the ratchet drive disc 49 in the clutch-off condition, the stopper spring 51 becomes engaged with the notches 6*a* and 49*a*, locating them at the same angular position to disengage the ratchet 47 from the ratchet wheel 46 against the action of the spring 52.

An extended member 55 is securely fixed on the free end portion of said stopper spring 51 which is engaged with a trigger lever 56. Said trigger lever 56 is mounted swingably on a bracket 57 of the frame body 10 as is shown in FIG. 1. Said trigger lever 56 has a roller 58 on another extended portion thereof, said roller 58 is pressed against a side end surface of said flange 40 by a spring (not shown in the drawings). When the flange 40 is shifted leftward against the spring 43, the trigger lever 56 is swung in the counterclockwise direction in FIG. 1 to push down the stopper spring 51 and to disengage it from the notches 6*a* and 49*a* thereby enabling the one-cycle clutch so that the cam 6 begins to rotate in the direction of arrow A. After return of the trigger lever 56, the stopper spring 51 again comes in contact with the cam 6 on the perphery thereof, and the notches 6*a* and 49*a* become successively engaged with the stopper spring 51, which makes the ratchet 47 escape from the ratchet wheel 46. Thus, one rotation of the cam 6 is performed.

A limit-switch 59 for resetting the electromagnets 26 and 27 is mounted on the frame body 10, the actuator thereof being spaced on a rotary locus of the drive pin 9 which is fixed on the cam 6 thereby ensuring resetting of the electromagnets during each rotational cycle of the cam 6.

A feed shaft 8 for the check or the like document is mounted rotatably on the bracket 34 and another bracket 60 of the frame body 10. Said shaft 8 is spaced parallel to the drive shaft 32 beneath the flat portion 10*b* of the frame body 10, and the shaft has mounted thereon a pair of feed wheels 7 just beneath the receptacle 11 and a ratchet wheel 61 of a one-way clutch near the cam 6. The uppermost portions of said feed wheels 7 are slightly projected from the receptacle upper surface through the flat portion 10*b*, so that the check or the like is to be held between the feed wheels 7 and opposite rollers (not shown in drawings) during the printing operation.

Ajacent to said ratchet wheel 61, a one-way clutch lever 62 is rotatably mounted on the feed shaft 8 as shown in FIG. 4*a*. Said one-way clutch lever 62 has a ratchet 63 thereon, which is swingable around a pin 64 on the one-way clutch lever 62 and is meshed with the ratchet wheel 61 by a spring 65 set between the lever 62 and the ratchet 63. The one-way clutch lever 62 is forced toward a stopper pin 66 adjustably set on the frame body 10 by a spring 67 set between the lever 62 and the frame body 10. The free end of the one-way clutch lever 62 is engageable with said drive pin 9 on the cam 6. In one rotation of the cam 6, the drive pin 9 once engages with the one-way clutch lever 62 to rotate it a given angle and, consequently the ratchet 63 rotates the ratchet wheel 61 a desired number of teeth. The number of teeth fed by one feeding is to be controlled by the stopper pin adjustment. After with engagement of the drive pin 9 to the one-way clutch lever 62, the one-way clutch lever returns back to its initial position while the ratchet wheel 61 remains at its newly set angular position.

In addition, a toothed ring 68 is fixed coaxially on the rear side of the type ring 2, and a positioning member 69 is mounted on the frame body 10. The type ring positioning is thereby insured by the toothed ring 68 engagement with the positioning member 69.

Figure 5:
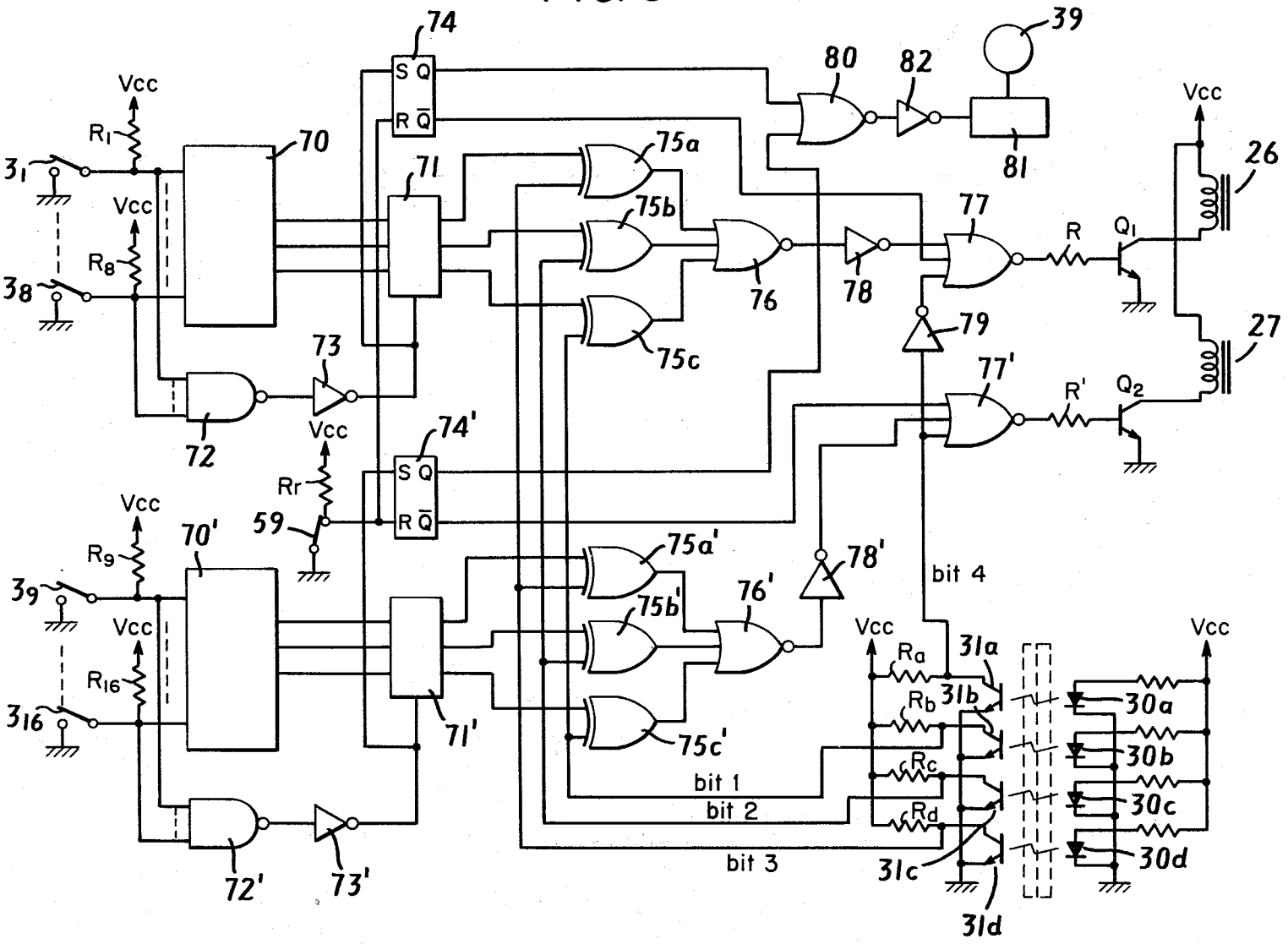
FIG. 5 is a schematic circuit diagram which may be employed by the device of FIG. 1.

FIG. 5 shows a preferred control circuit of the printing or stamping device of this invention, including the angular position detector, encoder memories and a coincidence detector.

Said key-switches are divided into two groups, $3_1$ to $3_8$ and $3_9$ to $3_{16}$, and key-switches belonging to a first group are respectively connected to a first encoder 70, a second group to a second encoder 70'. Type-in signals are encoded by the encoders into binary 3 bit codes, according to the table in FIG. 6, and output signals are delivered therefrom and fed to the respective latching memories 71 and 71', such as flip-flop circuits.

Each of the input terminals of the encoders 70 and 70' is connected to direct current source V*cc* through resistors $R_1$ , $R_2$ . . . $R_{15}$ and $R_{16}$ and is also connected to NAND gates 72 and 72', with a first group to 72 and a second group to 72' output of the NAND gate 72 (72') is connected through an inverter 73 (73') to the control terminal of the latching memory 71 (71') and to the set terminal S of a reset-set flip-flop circuit 74 (74') which will be described later.

The output terminals, corresponding to the 3-bits, of the latching memory 71 (71') are connected to first input terminals of exclusive-OR gates 75*a*, 75 *b* and 75*c* (75*a'*, 75*b'* and 75*c'*) respectively. Thus, type-in signals are transmitted to each of exclusive-OR gates 75*a*, 75*b* . . . 75*b'* and 75*c'*, so converted that bit 1 will be transmitted to gate 75*c* when bit 4 is 0-level, or to gate 75*c'* when bit 4 is 1-level, bit 2 to gate 75*b* (when bit 4 is 0-level) or to gate 75*b'* (when bit 4 is 1-level) and bit 3 to gate 75*a* (when bit 4 is 0-level) or to gate 75*a'* (when bit 4 is 1-level).

The light sensitive elements 31*a*, 31*b*, 31*c* and 31*d* are connected to the direct current source V*cc* through resistors R*a*, R*b*, R*c*, or R*d* respectively, those elements of 31*b* being, 31*c* and 31*d* connected to second input terminals of said exclusive-OR gates 75*a*, 75*b* . . . 75*b'* and 75*c'*, with element 31*b* connected to 75*c* and 75*c'*, 31*c* to 75*b* and 75*b'*, and 31*d* to 75*a* and 75*a'*, directly at the collectors thereof. The emitters of these phototransistor elements are ground.

The output terminals of said exclusive-OR gates 75 *a* to 75*c* (75*a'* to 75*c'*) are connected to 3-input NOR gate 76 (76'). The output terminal of said NOR gate 76 (76') is connected to a first input terminal of 3-input NOR gate 77 (77') through an inverter 78 (78'). Output terminal $\overline{Q}$ of the reset-set flip-flop circuit 74 (74') is connected to a second input terminal thereof, and the collector of light-sensitive element 31*a* is connected through an inverter 79 to a third input terminal of the NOR gate 77 and directly to that of the NOR gate 77'.

The reset terminal R of the reset-set flip-flop circuit 74 (74') is connected to the direct current source V*cc* through a resistor $R_r$ and to the ground through the limit switch 59 which has a NORMAL OPEN contact therein. Therefore, switching-on of the limit switch 59 resets the flip flops 74 and 74', as Q : 0 level and $\overline{Q}$ : 1 level.

The output terminal Q of the flip flop 74 (74') is connected to a NOR gate 80 and its output is further connected to a motor controller 81 for the motor 39 through an inverter 82. Said controller 81 enables or places into operation the motor 39 when the inverter 82 inputs a high level (1 level).

The output terminal of said NOR gate 77 (77') is connected through a resistor R (R') to the base of transistor $Q_1$ ($Q_2$). The emitter of the transistor $Q_1$ ($Q_2$) is connected to ground and the collector is connected through the solenoid of the electromagnet 26 (27) to the direct current source V*cc*.

The operation of the above-mentioned printing or stamping device will be described hereinafter.

When of the key-switches $3_1$ to $3_{16}$ is pushed turn on, the output of a corresponding NAND gate 72 or 72' will be shifted to 1-level from 0-level, and sequentially inverter 73 or 73' will change its output into 0-level thereby controlling latching memory 71 or 71' and making it be ready to receive and store an input. A 3-bit coded signal corresponding to the pushed-on key-switch is transmitted from encoder 70 or 70' to latching memory 71 or 71' and recorded there.

Pushing off the key-switch makes the control terminal input return to 1-level again, which causes the transmitting of the signal recorded in the latching memory to exclusive-OR gates 75*a*, 75*b* and 75*c*, or (75*a'*, 75*b'* and 75*c'*), in accordance with the foregoing description, and, at the same time, causes reset-set flip-flop 74 or 74' to be set, shifting the output Q to 1-level and $\overline{Q}$ to 0-level, the 1-level of the output Q being transmitted to control circuit 81, through NOR gate 80 and inverter 82, the to initiate starting of the drive motor 39.

Motor 39 synchronously drives, the type shaft 15 and index shaft 18 through worm gears 38 and 39, flange 40 which is rotationally fixed on shaft 32, the larger pulley 35 which is at this time engaged with flange 40 and which transmits the rotary motion of larger pulley 35 to the belt 36, and smaller pulley 21.

The rotary member 4 rotates together with the index shaft 18 and according to the angular position of the rotary member 4, angular position coded signals, produced by perforations 28 in the rotary member, are successively detected by the light-sensitive elements 31*a*, 31*b*, 31*c* and 31*d*. The successive coded signals are converted into signal bits according to the table of FIG. 6 and, in accordance with the foregoin description, the signal bits are divided to be transmitted respectively into exclusive-OR gates 75*a*, 75*b* . . . 75*b'* and 75*c'*, and into 3-input NOR gates 77 and 77'. Each of exclusive-OR gates 75*a*, 75*b* . . . 75*b'* and 75*c'* changes its output to 0-level when both of the input bits coincide. The 3-bit NOR gate 76 or 76'detects the coincidence of 3-bit signals, one from the key-switch and the other from the angular position detector, changing its output level thereof to 1-level. This 1-level signal is converted by inverter 78 or 78' to an 0-level signal which is transmitted to the 3-input NOR gate 77 or 77'.

As afore-mentioned, the output $\overline{Q}$ of reset-set flip-flop 74 or 74'is held at 0-level after the key-switch is pushed on, so second inputs of 3-input NOR gate 77 and 77' are 0-leveled. The coincidence of the input signals are finally checked at the 3-input NOR gates 77 and 77', NOR gate 77 changing its output to 1-level and the output of NOR gate 77' remaining at 0-level when bit 4 of the angular position signal is at 1-level and vice versa when at 0-level.

Thus, at a moment of coincidence of the input signal transmitted from a push-on switch through the memory with that of an input signal from the angular position detector, the electromagnet 26 (or 17) begins to be excited, with a 1-level input being applied to the base of transistor $Q_1$ (or $Q_2$), to pull the stop member 24 (or 25) in the clockwise direction in FIG. 3*a* with its plunger 24*a* (or 25*a*). The engaging end portion of the stop member is brought into pressure contact with the cylindrical braking portion 23*a* (or 23*b*) of the index ring 103 thereby braking the index ring, whereby the speed of rotation of the type shaft 15 and indexing shaft 18 rapidly decreases. Then the engaging end portion of the stop member 24 (or 25) engages with a specific catching portion 22*a* (or 22*b*) due to the index ring low thereby rotation stopping the index rings 103 with the type ring 2 in a specific angular position corresponding to the typed-in key. Thus desired type on the type ring is positioned in opposed facing relationship a check or the like document on receptacle 11.

The larger pulley 35, which is engaged with belt 36, is also stopped thereby and flange 40 is driven axially leftward along shaft 32 in FIG. 1 against the force of the spring 43 so the the project portion 35*a* thereof moves out of the recess 40*a* and into contact with the end face of the flange according to the further rotation of the flange. The pulley 35 is thus kept free from drive shaft 32 till the pulley projected portion 35*a* will again come to face the flange recess 40*a* after one rotation of drive shaft 32.

On the other hand, the leftward shift of flange 40 makes trigger lever 56 swing in the counterclockwise direction in FIG. 1 to disengage stopper spring 51 from cam 6, pushing down the stopper spring 51 against the spring action thereof. Then, the one-cycle clutch operation is performed as afore-mentioned, rotating cam 6 in the direction of arrow A in FIG. 4*a* synchronously with the drive shaft by one rotation. Printing lever 5 is swung in the counterclockwise direction in FIG. 1, bending flexible member 20, to press the type 2*a* toward a check or the like document on receptacle 11, the correct position being assumed by a tooth of ring 68 making pressure contact with the positioning member 69, when the convex camming projection 6*b* on cam 6 comes in contact with cam follower 16 of the lever 5. Thus, a desired letter has been printed on a check or the like.

In response to further rotation of cam 6, pin 9 on the cam 6 becomes engaged with operating lever 62 of the one-way clutch thereby rotating feed shaft 8 by a predetermined angle so that feeding wheels 7 feed and advance the check or the like document by a desired length.

By further rotation of cam 6, the recess 40*a* of flange 40 again receives and engages with the projected portion 35*a* of pulley 35 and trigger lever 56 returns back releasing stopper spring 51 to be in pressure contact with the notch portion 6*a* to declutch or clutch off the one-cycle clutch. Just before stopping of the cam, pin 9 operates limit switch 59 which resets R-S flip-flops 74 and 74'. Thus, the control circuit is reset to be in the initial condition, switching off the motor 33 and the elctromagnet 26 or 27.

Latching memories such as those to store multiple input signals transmitted successively from key-switches and to supply them, one by one, to next gates, may be used for this embodiment. Using latching memories of this kind, their control terminals for supplying stored signals and reset terminals R of R-S flip-flops should be connected to suitable elements, such as limit switches, which are operated when a preceding typing operation is finished.

Figure 8:
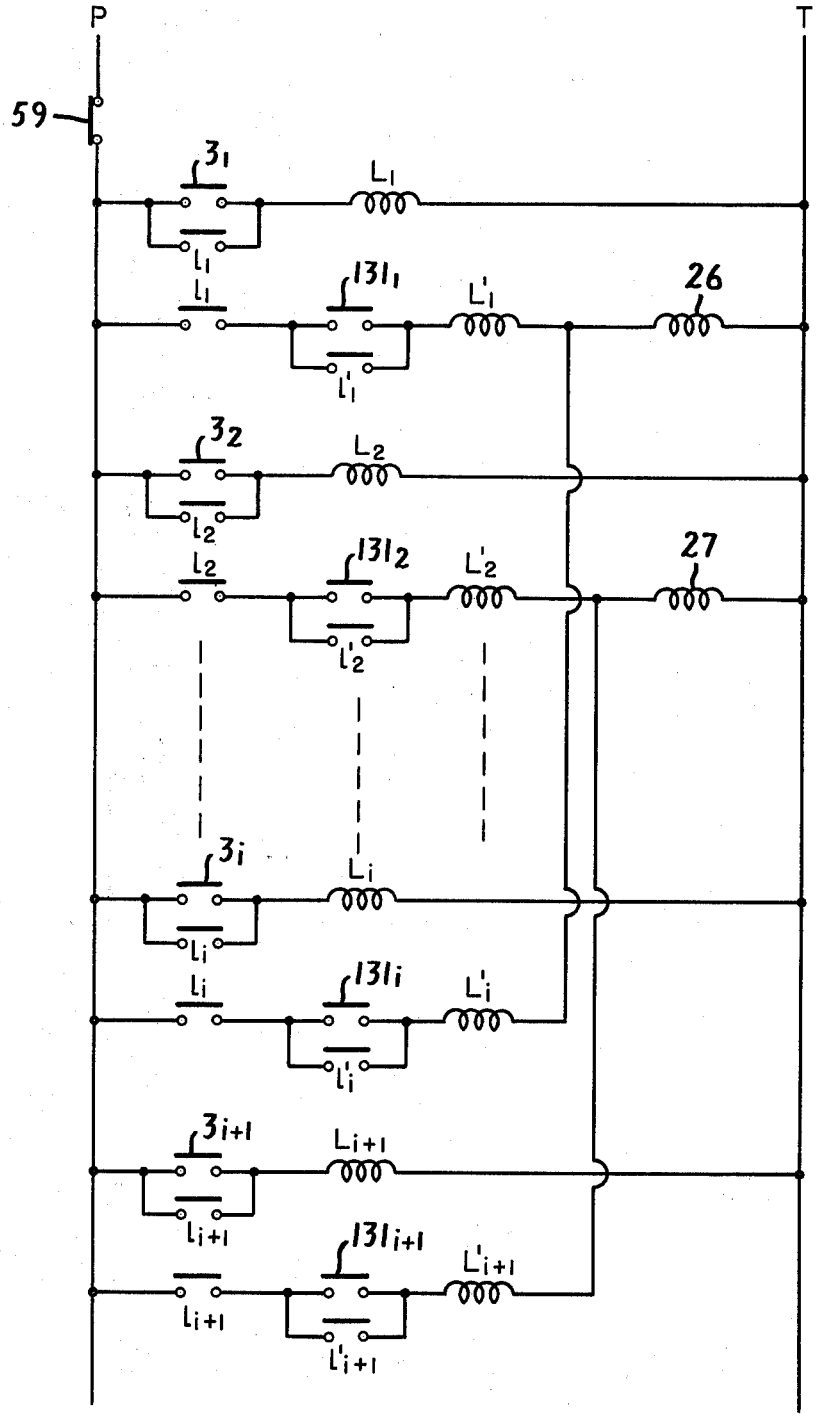
FIG. 8 is a circuit diagram suitable for the device using the angular position detector of FIG. 7.

Another preferred embodiment of the present invention is shown in FIGS. 7 and 8, in which the angular position detector comprises a rotary member 104 fixed on the indexing shaft 18 having a permanent magnet 128 therein, affixed thereto. Maget sensing elements $\mathbf{131}_1$ to $\mathbf{131}_{16}$ such as read switches, corresponding to the types on the type ring, are arranged in a circle facing the rotary locus of said magnet 128 on frame wall 10c. Numeral 121 is a disc on which is provided index rings 103.

In FIG. 8, $L_1 \ldots Li, Li+_1$ etc are relay solenoids, each of which is connected between the corresponding key-switch and a power supply terminal T and has two normal-open contacts $l_i$, one of the contacts being parallel with the corresponding key-switch for memory function and the other being connected between the other power supply terminal P and a corresponding one of said magnet sensing element $\mathbf{131}_1$ to $\mathbf{131}_{16}$. $L'_1 \ldots L'_i, L'_{i+l}$ etc. are also relay solenoids, of each of which is connected between the corresponding magnet sensing element $\mathbf{131}_i$ and one of the electromagnet solenoids, the relay solenoids having odd-numbered suffix being connected to solenoid 26, ones having evennumbered suffix being connected to solenoid 27.

Other numberals in FIGS. 7 and 8 are used to refer to parts which are equivalent to parts described in the former embodiment.

Coincidence function in the circuit of FIG. 8 is carried out by each series connection of one of the contacts $l_i$ and magnetic sensing element $\mathbf{131}_i$.

In this second embodiment, other constructions may be similar to the first embodiment, while the ink roller should be removed, the types should be provided with milled surface to stamp milling marked letters, and the drive motor may be in continuous rotation as the easy-wear ink roller is absent.

It is further understood by those skilled in the art that various changes and modifications may be made in the invention without departing from the spirit and scope thereof as described in th appended claims.

What is claimed is:

1. A printing device for printing type symbols on a sheet comprising: a rotatable type ring having a plurality of types on the peripheral surface thereof and being fixed on one end portion of a shaft; a pivotable printing lever rotatably supporting thereon said shaft with said type ring being located at a free end of said printing lever; angular positioning means responsive to a coincidence signal for positioning said type ring at a preselected angular position; angular position detecting means coacting with said angular positioning means for detecting successive angular positions of said type ring and providing corresponding position signals; a plurality of actuatable key switches each corresponding to one of said types; means responsive to the actuation of each key switch for developing a corresponding input signal; a coincidence detector receptive of each position signal from said angular position detecting means and of the input signal developed by the actuation of each key switch and operative to detect coincidence of the two corresponding signals and provide an output coincidence signal to thereby enable said angular positioning means to angularly position the type ring; a rotatable cam in camming engagement with said printing lever and effective during rotation thereof to pivot said printing lever to thereby move said type ring toward a sheet to be printed; a one-cycle-operating clutch including a driven member connected to rotate with said cam and a driving member connected to a driving shaft and operative when actuated to its clutched state to rotationally drive said cam; a second clutch self-releasable under over-load and including a driven member connected to rotate with said type ring and a driving member connected to rotate with and movable along said driving shaft; and means including a pivotable trigger lever engageable with said driving member of said second clutch and operative in response to movement of said driving member along said driving shaft when an over-load is caused on the second clutch during positioning of said type ring in a preselected angular position for actuating said one-cycle-operating clutch to its clutched state whereby said cam pivots said printing lever to move said type ring toward the sheet to be printed.

2. A printing device as claimed in claim 1; further comprising feed means to feed the sheet step by step, said feed means having means engageable with said cam so as to effect feeding of the sheet after every printing operation.

3. A printing device for printing type symbols on a sheet comprising: a rotatable type ring having a plurality of types on the peripheral surface thereof and being fixed on one end portion of a type shaft; a movable printing lever rotatably supporting said shaft thereon with said type ring being located at a free end of said printing lever; actuatable driving means operative when actuated to move said printing lever to thereby move said type ring toward a sheet to be printed; an indexing shaft rotatably mounted on a fixed frame; angular positioning means connected to said indexing shaft and operative in response to a coincidence signal for angularly positioning said type ring; angular position detecting means coacting with said angular positioning means for detecting successive angular positions of said type ring and providing corresponding position signals; a flexible member connecting said indexing shaft with said type shaft; means for rotationally driving said indexing and type shafts; a plurality of actuatable key switches each corresponding to one of said types; means responsive to the actuation of each key switch for developing a corresponding input signal; a coincidence detector receptive of each position signal and of the input signal developed by the actuation of each key switch and operative to detect coincidence of two corresponding signals and provide an output coincidence signal to thereby enable said angular positioning means to position said indexing shaft and said type shaft in a preselected angular position; and means including a trigger mechanism operative when said indexing shaft is in said preselected angular position to actuate said driving means to effect movement of said printing lever to thereby carry out a printing operation by the type ring.

4. In a printing device for printing a document and the like and being of the type including a rotary type ring having around its periphery a plurality of types, and a keyboard having a plurality of actuatable keys corresponding to respective ones of said types on said type ring: drive means for rotationally driving said type ring through successive angular positions to successively position each of said plurality of types in a predetermined common printing position wherein the type occupying said printing position can be printed on a document; detecting means for detecting successive angular positions of said type ring and providing corresponding position signals; control circuitry including means responsive to the actuation of each key for developing a corresponding keyed-in input signal, and a coincidence detector receptive of the position signals and each keyed-in input signal and operative to detect coincidence of each input signal and its corresponding position signal and provide an output signal indicative of such signal coincidence; stopping means responsive to the output signal and coacting with said drive means for effecting stoppage of the type ring rotation such that said type ring stops at a preselected position wherein they type corresponding to that which is keyed-in on said keyboard occupies said predetermined printing position; and means coacting with said drive means for moving said type ring towards a printing station to effect printing of the keyed-in type on a document, said means coacting with said drive means comprising a pivotable trigger lever, means responsive to pivotal movement of said trigger lever in one direction for effecting movement of said type ring towards the printing station, and means responsive to the rotational stopping of said type ring and coacting with said drive means for effecting pivotal movement of said trigger lever in said one direction.

5. A printing device according to claim 4; wherein said drive means includes a rotationally driven indexing shaft, a rotatable type shaft connected to said type ring, and flexible means interconnecting said indexing and type shafts so as to transmit the rotary motion of said indexing shaft to said type shaft to thereby effect rotation of said type ring in accordance with the rotation of said indexing shaft while allowing lateral movement of said type shaft relative to said indexing shaft; and said means coacting with said drive means for moving said type ring towards a printing station includes a movable printing lever having said type shaft and type ring rotatably mounted thereon, and means for effecting movement of said printing lever in a given direction to accordingly effect movement of said type shaft laterally relative to said indexing shaft to thereby move said type ring towards the printing station.

6. A printing device according to claim 5; wherein said flexible means comprises a torsionally rigid spring torsionally coupling said type shaft to said indexing shaft to transmit the rotary motion of said indexing shaft to said type shaft while permitting lateral movement of said type shaft relative to said indexing shaft due to flexure of said spring to enable movement of said type ring towards the printing station.

7. A printing device according to claim 4; wherein said drive means includes a rotationally driven drive shaft, a rotatable member rotatably mounted on said drive shaft, and means for transmitting the rotary motion of said rotatable member to said type ring; and said means coacting with said drive means for moving said type ring towards the printing station further comprises a clutch having a driving member connected to rotate with said drive shaft and being mounted for axial slidable movement along said drive shaft between clutch-in and clutch-out positions and being engageable with said trigger lever during movement to its clutch-out position, a driven member connected to said rotatable member and engageable with said driving member to be driven thereby when said driving member is in its clutch-in position to transmit the rotary motion of said drive shaft to said type ring and disengageable from said driving member when said driving member is in its clutch-out position, biasing means biasing said driving member towards its clutch-in position, and means responsive to the rotational stopping of said type ring to accordingly effect rotational stopping of said driven member to thereby cause axial sliding of said driving member along said drive shaft towards its clutch-out position accompanied by engagement of said driving member with said trigger lever to thereby pivot said trigger lever in said one direction.

8. A printing device according to claim 4; wherein said means responsive to pivotal movement of said trigger lever in one direction for effecting movement of said type ring towards the printing station includes a movable printing lever having said type ring rotatably mounted thereon, and means actuated in response to movement of said trigger lever in said one direction for effecting movement of said printing lever in a direction to move said type ring towards the printing station.

9. A printing device according to claim 8; wherein said means actuated in response to movement of said trigger lever includes a rotatable cam in camming engagement with said printing lever and effective during rotation thereof to move said printing lever in a direction to move said type ring towards the printing station, means for releasably locking said cam against rotation, and means responsive to movement of said trigger lever in said one direction to unlock said cam and effect clutching thereof to said drive means so that said drive means rotationally drives said cam.

10. A printing device according to claim 9; wherein said stopping means includes means responsive to a reset signal to render the same ineffective to stop the type ring rotation until receipt of another output signal from said control circuitry; and means operative during rotational movement of said cam towards completion of one cycle of rotation and after movement of said type ring towards the printing station to develop and apply a reset signal to said stopping means.

* * * * *